US006651390B2

(12) United States Patent
Camperelli

(10) Patent No.: US 6,651,390 B2
(45) Date of Patent: Nov. 25, 2003

(54) REINFORCING SYSTEM FOR A DOOR FRAME

(76) Inventor: James A. Camperelli, 10342 Mayfair Dr., Apt. 1, Baton Rouge, LA (US) 70809

( * ) Notice: Subject to any disclaimer, the term of this patent is extended or adjusted under 35 U.S.C. 154(b) by 0 days.

(21) Appl. No.: 10/163,699

(22) Filed: Jun. 5, 2002

(65) Prior Publication Data

US 2002/0174612 A1 Nov. 28, 2002

Related U.S. Application Data

(63) Continuation of application No. 09/538,444, filed on Mar. 29, 2000, now abandoned.

(51) Int. Cl.[7] ..... E06B 1/60; E06B 1/06
(52) U.S. Cl. ..... 49/504; 52/204.1
(58) Field of Search ..... 49/503, 504, 460; 52/210, 213, 215, 204.1; 292/340, 346

(56) References Cited

U.S. PATENT DOCUMENTS

| | | | | | |
|---|---|---|---|---|---|
| 1,083,529 | A | * | 1/1914 | Fletcher | 292/340 |
| 1,723,991 | A | * | 8/1929 | Baum | 52/215 |
| 1,792,725 | A | * | 2/1931 | Baum | 52/215 |
| 1,805,030 | A | * | 5/1931 | Baum | 52/215 |
| 1,853,456 | A | * | 4/1932 | Ross | 292/346 |
| 2,272,241 | A | * | 2/1942 | Fendring | 292/340 |
| 2,704,868 | A | * | 3/1955 | Danielson | 52/210 |
| 2,854,843 | A | * | 10/1958 | Lamb | 52/210 |
| 3,265,427 | A | * | 8/1966 | Williams | 292/341.18 |
| 3,369,333 | A | * | 2/1968 | Wheeler | 52/210 |
| 3,451,178 | A | * | 6/1969 | Beale | 52/210 |
| 3,473,265 | A | * | 10/1969 | Norman et al. | 49/504 |
| 3,676,966 | A | * | 7/1972 | Ragland | 52/211 |
| 4,005,890 | A | * | 2/1977 | Murch | 292/346 |
| 4,189,175 | A | * | 2/1980 | Paxton | 292/340 |
| 4,281,480 | A | * | 8/1981 | Wendt | 49/504 |
| RE31,276 | E | * | 6/1983 | Schlage | 292/340 |
| 4,770,452 | A | * | 9/1988 | Petree | 292/340 |
| 4,993,764 | A | * | 2/1991 | Barker | 292/340 |
| 5,024,475 | A | * | 6/1991 | Francis | 292/340 |
| 5,570,917 | A | * | 11/1996 | Cutrer | 292/346 |
| 5,575,123 | A | * | 11/1996 | Adams | 52/212 |
| 5,586,796 | A | * | 12/1996 | Fraser | 292/346 |
| 6,082,049 | A | * | 7/2000 | Hudson | 49/460 |
| 6,178,700 | B1 | * | 1/2001 | Mayer | 49/504 |

* cited by examiner

*Primary Examiner*—Gregory J. Strimbu
(74) *Attorney, Agent, or Firm*—Roy, Kiesel, Keegan & DeNicola

(57) ABSTRACT

A reinforcing system for strengthening a door frame having two parallel vertical doorjambs separated from one another by a top horizontal doorjamb. The reinforcing system comprises two elongated channel-shaped 90° corner members positioned in the upper opposite corners of the door frame. Each corner member comprises one elongated flat panel with two substantially parallel sides extending along and outward from the opposite edges of the flat panel. The flat panel has a width and the parallel sides extend in a direction permitting each of the parallel sides to be positioned adjacent one of the opposing sides of a doorjamb when the flat panel is positioned adjacent the exterior side of the doorjamb. The reinforcing system further comprises at least one elongated straight channel-shaped member otherwise similarly formed positioned on the doorjamb opposite where the door hinges will be attached. The reinforcing system further comprises a strike having a tubular body extending substantially perpendicular from its plate and into an opening through the doorjamb and into the wall stud to which the doorjamb is attached. The tubular body is closed at the extending end by an end plate having an opening shaped to permit a screw, nail or other similar attaching member to extend into the structural member to fix the tubular body to the wall stud.

11 Claims, 6 Drawing Sheets

REINFORCING SYSTEM FOR A DOOR FRAME

APPLICATION HISTORY

This application is a continuation of U.S. application Ser. No. 09/538,444, filed on Mar. 29, 2000, now abandoned, and is hereby incorporated by reference in its entirety.

BACKGROUND OF THE INVENTION

1. Field of the Invention

This invention relates in general to door frame structures, and in particular to reinforcing plates and banding systems utilized in the construction of lock strikes, door jam plates and framing forming part of a door frame.

2. Prior Art

It has long been recognized that a door mounted in a conventional door frame, even when dead bolted, offers little deterrence to a person who attempts to kick in the door to gain entrance to the building. Typically, external doors are mounted to the doorjamb by at least a pair of hinges and are provided with a latch and dead bolt lock that is extended into a recess provided in the jamb to secure the door in a closed position. The weakest region of a doorframe is the region where the bolt interacts with the doorjamb. The portion of the jamb that is provided for restraining the door bolt or latch generally measures only in fractions of inches and is commonly composed of wood. This material is easily splintered and broken through with only a moderate amount of force directed against the door adjacent the locking mechanism.

The solutions to this problem most relevant to this invention have involved the use of reinforcing plates placed at different positions around the door in the region of the lock or latch opening. Examples of such designs can be seen in the following U.S. Pat. Nos.: 3,673,605, 3,764,179, and 3,934,910; as well as Great Britain patent 2265664 (various U-shaped channels mounted to surround the latch opening and the door knob opening). However, such designs do nothing to solve the problem of the doorjamb being splintered when the door is kicked adjacent the door latch or lock. For this recent such door reinforcement plates have been augmented with reinforcing plates positioned on the doorjamb around the openings in the jamb for the latch or lock. U.S. Pat. No. 3,764,173 illustrates such a combination. Some of these reinforcing plates have been positioned on the exterior side of the doorjamb. Examples of such designs are illustrated in the following U.S. Pat. Nos.: 3,815,945, 4,171,837, 5,566,509, and 5,566,995; as well as Great Britain patent 2197677. Others have been positioned between the doorjamb and the support studs forming part of the wall. Examples of such designs are illustrated in the following U.S. Pat. Nos.: 4,057,275, 4,174,862, 5,241,790, 5,474,347, 5,5819,48, and 5,836,628. Still others have partially wrapped around the doorjamb. U.S. Pat. Nos. 4,717,185, 4,854,621, and 4,858,384 are illustrative of such designs. Finally, other designs have utilized reinforcing plates attached to the side of the doorjamb. Example of such designs are seen in U.S. Pat. Nos. 4,074,484 and 5,344,198.

Despite this multitude of designs there remains a need for a simple reinforcing plate that effectively strengthens a conventional door frame against being splintered when the door is kicked around the latch or lock openings.

Other prior art solutions relate to strengthening the striker plate by providing a tubular extension that fits into the latch or lock openings in the doorjamb. Examples of such designs are seen in U.S. Pat. Nos. 3,586,361, 4,211,442, 4,865,370 and 4,872,717. U.S. Pat. No. 4,684,160 discloses a variation wherein the reinforcing plate positioned between the doorjamb and wall studs is provided with extensions partially surrounding the interior of the latch or lock openings in the doorjamb. Although such designs do provide additional reinforcement, they are not capable of forming part of a fully integrated system that provides for reinforcement for all sections of the door frame.

Although there are some prior art systems such as seen in U.S. Pat. No. 4,295,299 that teach using a reinforcing plate wrapped partially around the doorjamb that can extend the height of the doorjamb, there are no reinforcement plates that are designed to the twisting forces incurred at the top and bottom corners of a door frame when a person attempts to kick in the door. Therefore there is a need for such a reinforcing system. In addition there is a need for a system that can be retrofitted to existing door frames.

Finally, other than for total metal doorjambs such as seen in U.S. Pat. No. 4,642,9554 there exists a need for totally integrated reinforcement system that provides reinforcement to all sections of a door frame that is subject to break-in efforts.

OBJECTS AND SUMMARY OF THE INVENTION

Therefore, one object of this invention is to provide an improved strike capable of providing reinforcement against attempted forced entry through a doorway. Accordingly, an improved strike having a plate containing at least one opening sized to receive a lock, a latch, or both fixed to a door is provided comprising a first tubular body having a first end extending substantially perpendicular to one face of the plate and a second end opposite the first end, the tubular body being of a length sufficient to extend through an opening in the doorjamb and into the stud or structural member forming part of the wall into which the door frame is positioned, the second end being closed by an end plate, the end plate provided with an opening shaped to permit an attaching means, such as a nail, screw or other similar device, to extend into the structural member to fix the tubular body to the structural member. In a preferred embodiment the strike plate will be provided with two openings for both a latch and a lock.

Another object of this invention is to provide a reinforcing plate for strengthening the upper adjacent corners of the doorjamb. Accordingly, a reinforcing plate is provided comprising an elongated channel-shaped 90° corner member shaped by one elongated flat panel bent in its middle section at approximately a 90° angle with two substantially parallel sides extending along and outward from the opposite edges of the flat side, the flat panel having a width to permit said substantially parallel sides to be positioned adjacent the inner edge and the outer edge, respectively, when the flat panel is positioned adjacent the interior side. In a preferred embodiment, both parallel sides will be of sufficient width to provide reinforcement against twisting forces exerted against the interior and exterior edges of the doorjamb causing them to splinter or crack when the door is struck. In a more preferred embodiment the parallel sides will be a width approximating the width of the interior edge of the doorjamb. Still more preferred is that the reinforcing plate be constructed of 14 to 20 gauge sheet metal, most preferably 16 gauge sheet metal, or such similar structural material.

A further object is to provide a reinforcing plate for strengthening the lower adjacent corners of the door frame. Accordingly, a reinforcing shaped plate is provided comprising an elongated flat section positionable on the floor below the threshold and at 90° thereto an elongated channel-shaped section whose width permits one of the vertical doorjambs to functionally fit in the channel.

Still another object of this invention is to provide a reinforcing system for strengthening a door frame. Accordingly, a reinforcing system is provided comprising two elongated channel-shaped 90° corner members whose flat panel is positioned on the interior side of the doorjamb with its two side panels positioned adjacent the inner and outer edges of the doorjamb, respectively, at least one elongated channel-shaped member whose flat panel is positioned adjacent the interior side of the doorjamb opposite where the door hinges will be attached to the doorjamb, and a strike having a tubular body extending through the doorjamb and into the studs or supporting member forming part of the wall. In a preferred embodiment the tubular body will have a closed end extending into the studs or supporting member. This closed end will be provided with an opening through which an attaching means such as a screw can be extended to fix the tubular cylinder to the supporting structure. In a further preferred embodiment each of the members of the system are connected by elongated flat members sized to be positioned adjacent the interior side of the doorjamb. In a still further preferred embodiment one or more of the elements in the system are constructed from 14 to 20 gauge sheet metal.

BRIEF DESCRIPTION OF THE DRAWINGS

The accompanying drawings illustrate a preferred embodiment of this invention. However, it is to be understood that this embodiment is not intended to be neither exhaustive, nor limiting of the invention. It is but one example of the form in which the invention may be practiced and is given for the purpose of illustration in order that others skilled in the art may fully understand the invention and the principles thereof and the manner of applying it in practical use so that they may modify and adapt it in various forms, each as may be best suited to the conditions of a particular use.

PREFERRED EMBODIMENTS OF THE INVENTION

Figure 1:
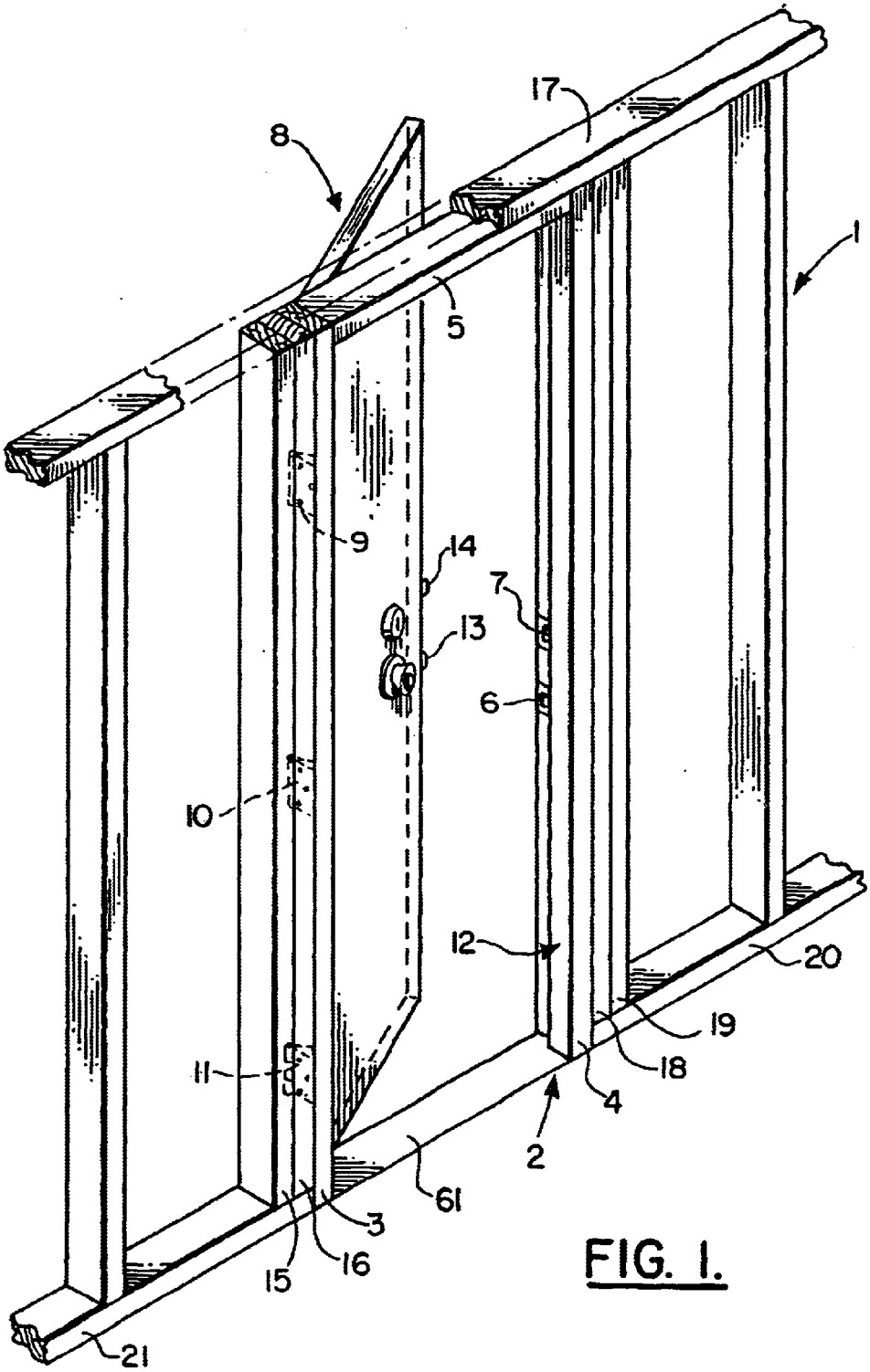
FIG. 1 is a perspective cutaway view of a conventional door frame illustrating the various elements comprising a preferred embodiment of the reinforcing assembly.

Without any intent to limit the scope of this invention, reference is made to the figures in describing the preferred embodiments of the invention. Referring to FIG. 1 a cutaway partial view of a typical wall 1 having a conventional door frame 2 forming a door way is illustrated. The door frame 2 includes two vertical doorjamb members 3, 4 and one upper horizontal doorjamb member 5 that separates the vertical doorjamb members 3, 4 to form threshold 61. One of the vertical doorjamb members 3 is provided with a latch opening 6 and a lock opening 7. A door 8 will be pivotly connected by hinge assemblies 9, 10, and 11 to vertical doorjamb 4 in a manner to permit the door to shut against jamb 12 of doorjamb member at a position aligning the door latch 13 and door lock 14 with the latch opening 6 and lock opening 7, respectively. The doorjamb members 3, 4 and 5 will typically be nailed to wall studs 15–19 that are attached vertically to floor plate members 20 and 21, as shown. In order to square up door frame 2, shims (not shown) may be positioned between the studs and the doorjamb members.

Figure 2:
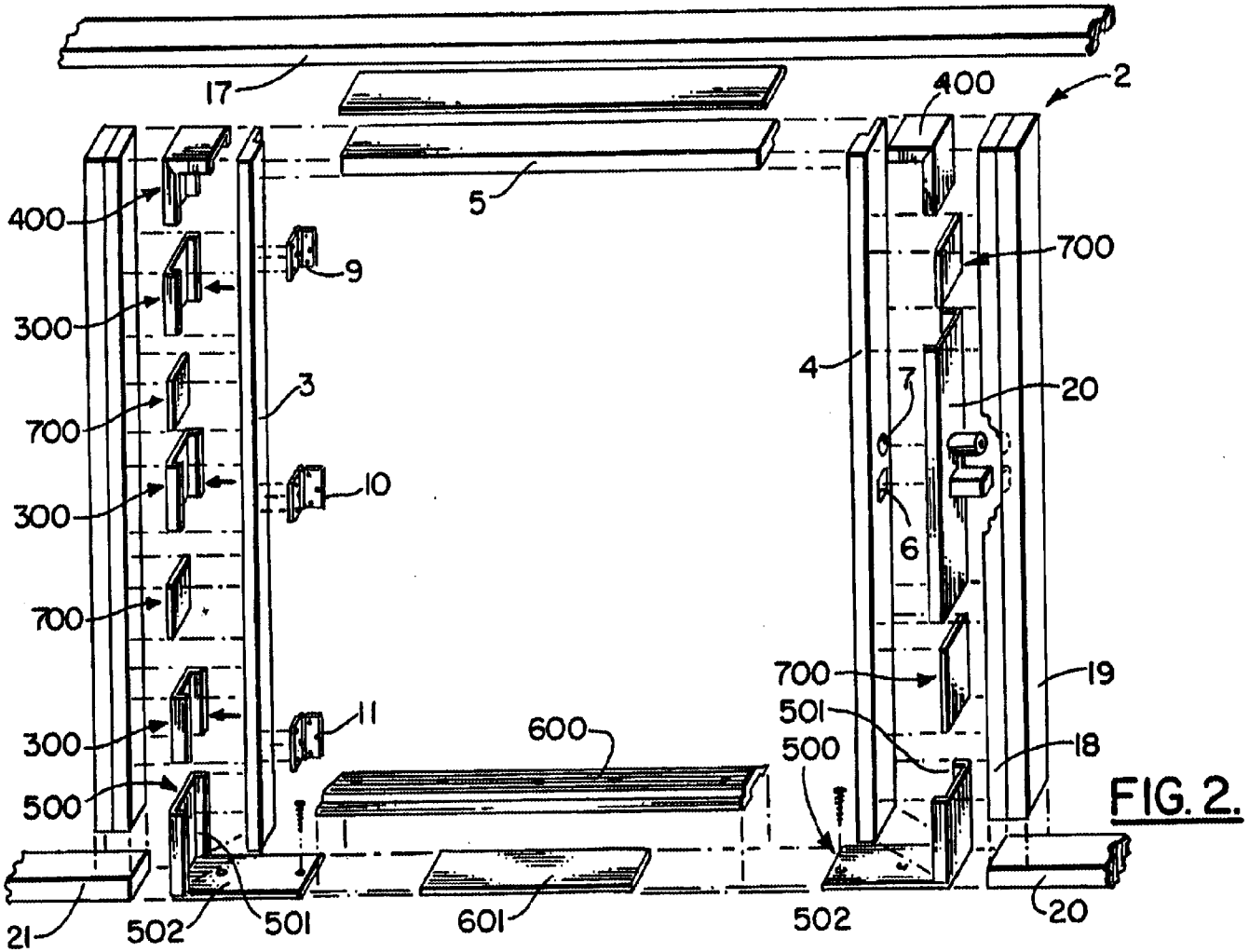
FIG. 2 is a perspective exploded view of a preferred embodiment of the improved strike of this invention designed for use with a door having both a latch and lock.
Figure 2A:
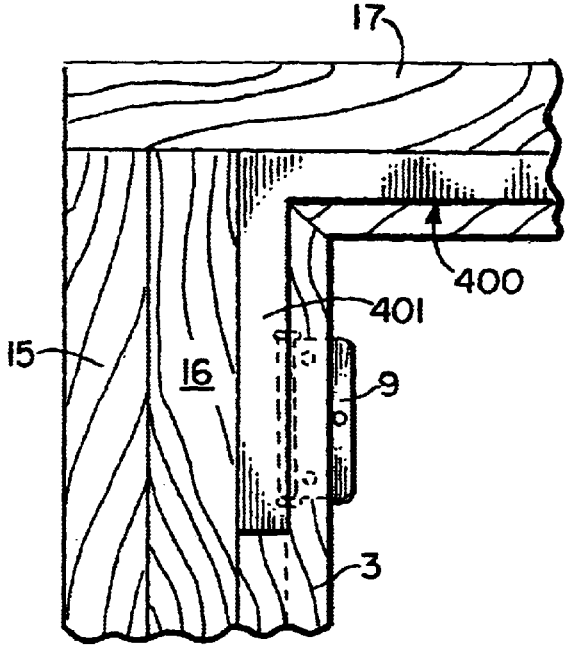
FIG. 2A is a side view of a preferred embodiment of the invention illustrating the upper channel-shaped 90° corner reinforcing member.

As best seen in FIGS. 2 and 2A, one preferred embodiment of the reinforcing system of this invention comprises a strike 20 positioned between doorjamb member 4 and stud 18 opposite the latch and lock openings 6, 7, respectively; one or more channel-shaped members 300 positioned between doorjamb member 3 and stud 16 opposite one or more of hinges 9–11; and at least one upper channel-shaped 90° corner member 400 positioned between doorjamb member 3 and 5 and studs 17 and 16 or 18, respectively, in one of the upper 90° corners formed by the door frame 2. In a more preferred embodiment channel-shaped member 300 will extend opposite each of the door hinges 9–11. In another alternative as shown in FIG. 2A, upper channel-shaped 90° corner member 400 will have its vertical section 401 extend down past the upper hinge 9 to provide additional reinforcement against the twisting forces resulting from a kick on door 8 adjacent door lock 14. In the last alternative preferably two elongated channel-shaped members 300 will be utilized with one positioned opposite each of the other two door hinges 10 and 11. It is noted that the length of channel-shaped members 300 can vary, but should be sufficient to extend the length of the hinges opposite to which they are positioned. The greater the length the more reinforcement will be provided to the door frame. It is preferred that they be at least longer than wide.

In another preferred embodiment lower partial channel-shaped corner members 500 will be fixed in position at the two bottom corners of the door jamb. Each member 500 will comprise a vertical channel-shaped section 501 shaped to permit one of vertical doorjamb members 3 or 4 to fit into the channel formed by section 501. Each member 500 will also comprise an elongated section 502 that extends substantially perpendicularly from section 501 to be positionable over the door sill so that threshold 500 can be fitted over sections 502. More preferably, each of sections 502 will be of a sufficient length to permit nailing to the floor to form reinforcement for the bottom corners.

In another preferred embodiment also illustrated in FIG. 2, the reinforcing system will further comprise a series of flat members 700 that connect each of the other member 200, 300, 400 and 500 to form a continuous reinforcing member that extends behind the length of the doorjambs 3–5. In still another preferred embodiment if a threshold 600 extends between doorjambs 3 and 4 at the floor level a threshold reinforcing member 601 can be positioned under the threshold 600 and connect the two flat sections 501. The most preferred embodiment is that all elements comprising the reinforcing system would be formed from one continuous piece of suitable material such as sheet metal having a gauge between 14 and 20.

Figure 3:
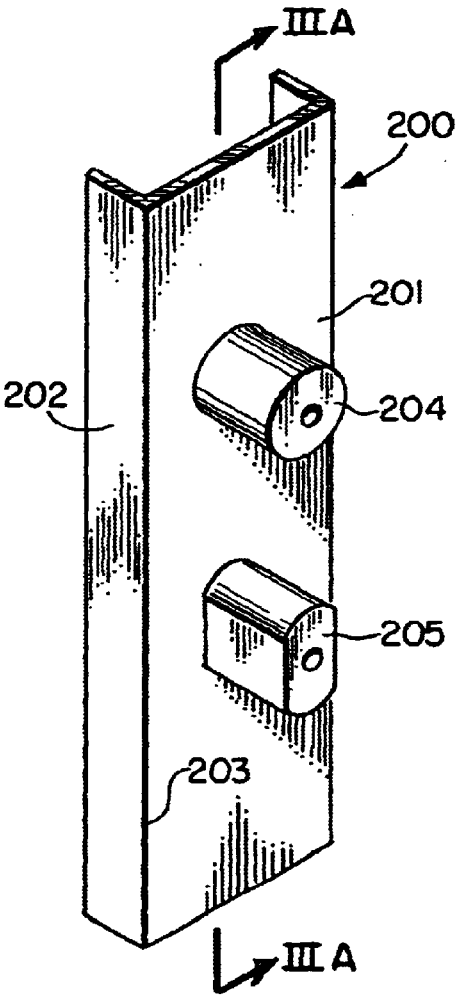
FIG. 3 is a perspective view of a preferred embodiment of the reinforcing plate utilized in that section of the doorjamb to which the door hinges are to be attached.
Figure 3A:
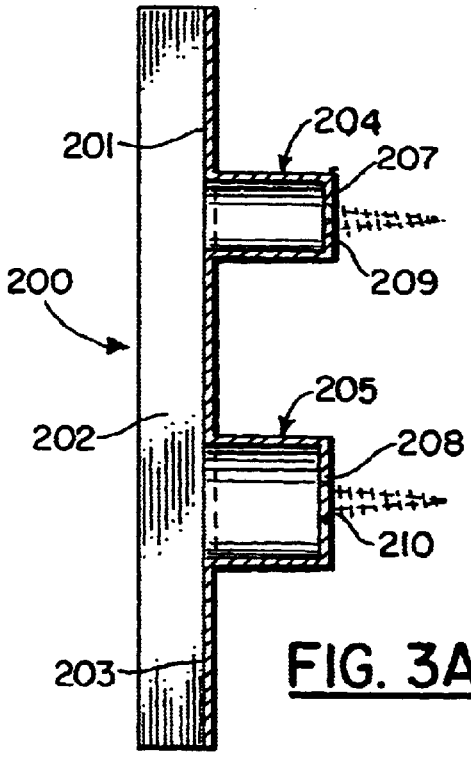
FIG. 3A is a cross-sectional view taken along lines IIIA—IIIA of FIG. 3.

In FIGS. 3 and 3A the strike 200 is constructed having a flat panel 201 with at least one side panel 202 extending perpendicular from one edge 203 of flat panel 201 to form an L-shaped member. Extending perpendicular from the opposite surface of flat panel 201 are a first tubular member 204 and a second tubular member 205 for receiving the door latch 13 and door lock 14, respectively. These tubular members may have any desired cross-section and length necessary to accommodate the shape of the latch or lock. These tubular members are further distinguished in that each is closed at the interior end by a cap plate 207 and 208, respectively. Both cap plates are provided with an opening 209 and 210, respectively, sized to permit a nail, screw or other attaching means 209 and 210, respectively, to fix the strike to studs 18 and 19. It is preferred that the attaching means be of sufficient length to extend through studs 17 and 18. It is preferred that the length of both tubular members 205 and 206 require them to extend at least into aligning openings in stud 18. In this manner the strike plate better utilizes the strength of the studs, as well as the doorjamb to prevent the twisting motion of the strike 200 that would be necessary to kick in door 8. It is preferred that the cross-sectional shape of the tubular member cavities be shaped to minimize the play between the latch and lock in the cavities. A preferred way to achieve this desired result is to closely conform the cross-sectional shape of the cavities to the latch and lock, respectively. Likewise, it is preferred that the openings in stud 18 that accommodate tubular members 205 and 206, respectively, also conform to the exterior cross-section of the tubular members to eliminate as much play as possible between the walls of the stud openings and the tubular members. Unlike prior art designs the strike of this invention permits the use of a single strike to accommodate both a round latch and a rectangular lock while still being able to utilize the strength of the studs 18 and 19 to prevent twisting.

Figure 4:
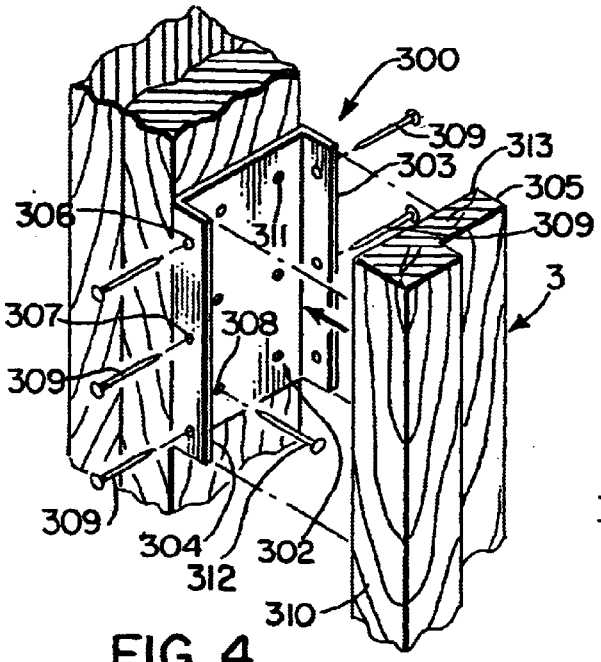
FIG. 4 is a perspective view of a preferred embodiment of the channel-shaped reinforcing member attached to the studs or structural members forming part of the wall.
Figure 4C:
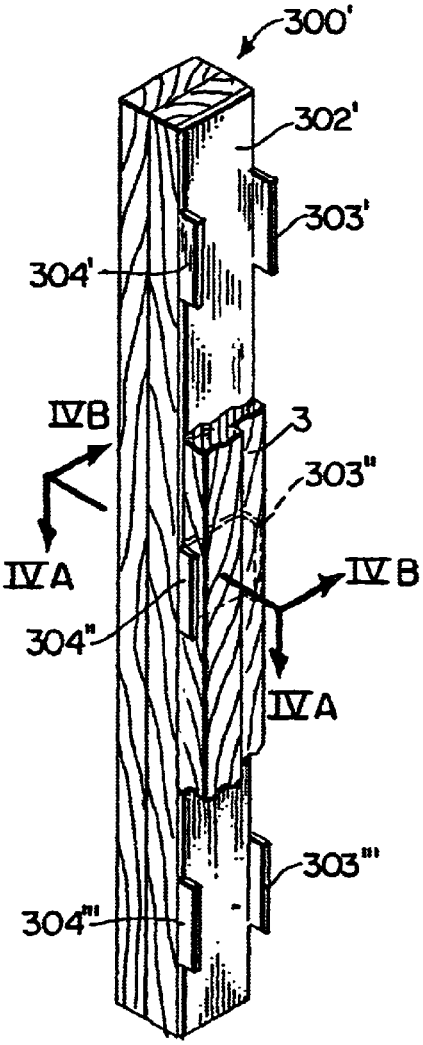
FIG. 4C is an alternate preferred embodiment of FIG. 4.
Figure 4B:
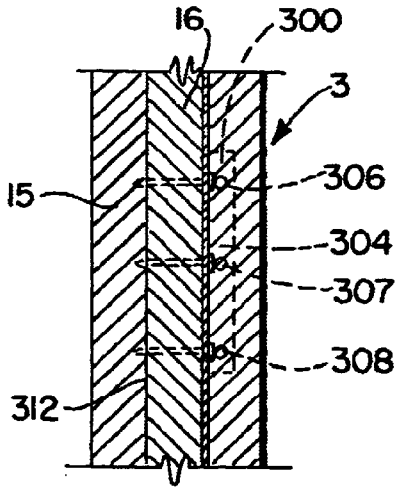
FIG. 4B is a cross-sectional view taken along lines IVB—IVB of FIG. 4.
Figure 4A:
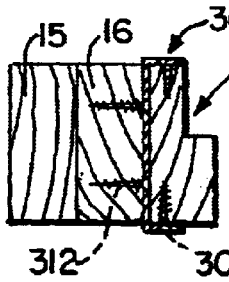
FIG. 4A is a cross-sectional view taken along lines IVA—IVA of FIG. 4.

A preferred embodiment of the channel-shaped member 300 is illustrated in FIGS. 4, 4A and 4B. In this embodiment doorjamb 3 is constructed having a first side 313 that will face stud 16 when member 300 is fixed in place against stud 16, and an opposing side 314 that forms door stop 315. Sides 314 and 315 are separated by opposing narrower sides 305 and 310. Side 305 not constructed in part by stop 315 is narrower than side 310. Member 300 is constructed to have a flat plate 302 with parallel outwardly extending sides 303 and 304 that form the channel shape into which doorjamb 3 can fit. In a preferred embodiment, sides 303 and 304 will have approximately the same width as the doorjamb interior side 305. Such construction provides increased reinforcement against the twisting forces resulting in any effort to break in a door. In a still more preferred embodiment each side 303, 304 will be provided with one or more, most preferably at least three, openings 306, 307, 308 that are each sized to permit a nail, screw or similar attaching means 309 to securely fix sides 303 and 304 to the doorjamb interior and exterior sides 305, 310, respectively. It is also preferred that flat 302 be provided with one or more openings 311 sized to permit a nail, screw or similar attaching means 312 to secure panel 302 to studs 15 and 16.

In an alternate embodiment member 300 can extend up to the full length of doorjamb 3. In another alternate embodiment it can be shaped such as illustrated in FIG. 4C. In FIG. 4C member 300' has parallel sides 303', 303", 303'", 304', 304" and 304'" that extend along the edges of flat panel 302' to be positioned opposite the hinges 9–11 mounted to doorjamb 3.

Figure 5:
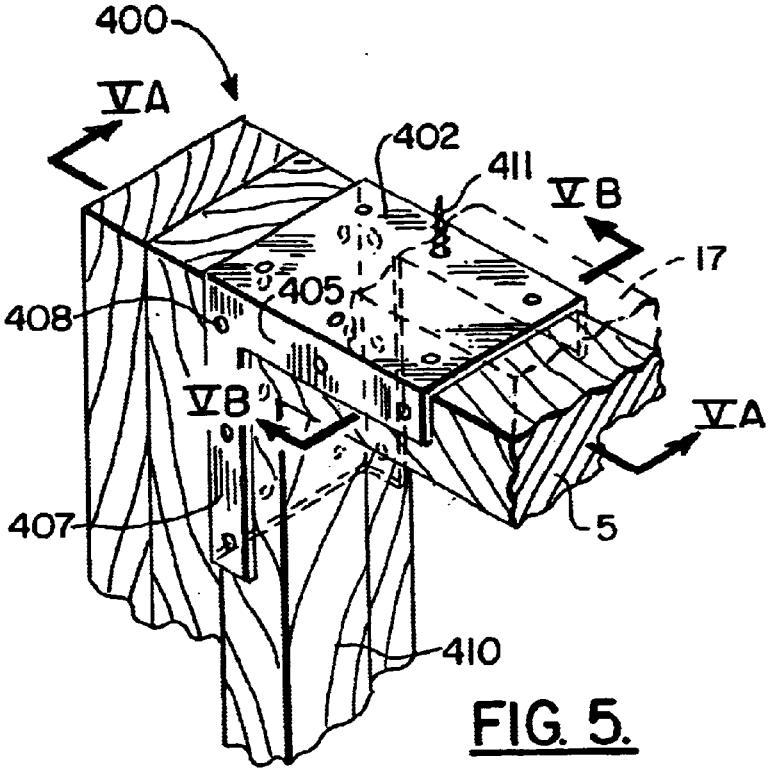
FIG. 5 is a perspective view of a preferred embodiment of the reinforcing system utilizing a threshold member and other members connecting the channel-shaped 90° corner reinforcing members to each other and the hinge reinforcing members or strike.
Figure 5A:
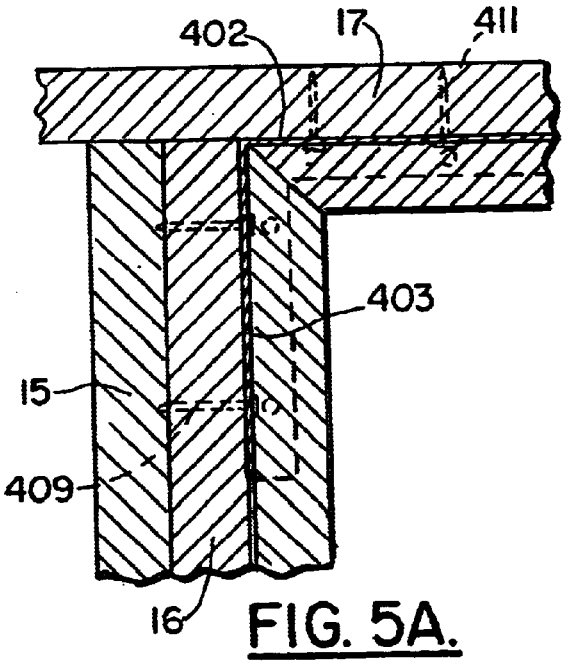
FIG. 5A is a cross-sectional view taken along lines VA—VA of FIG. 5.
Figure 5B:
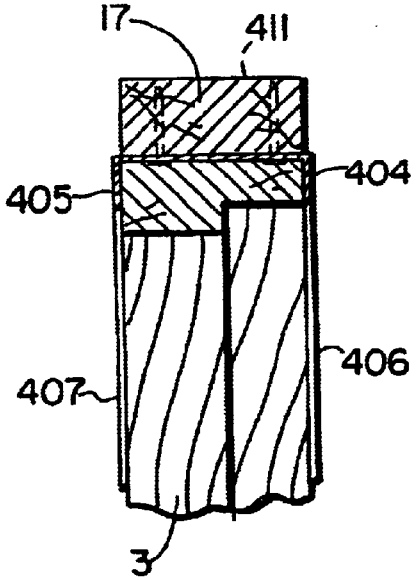
FIG. 5B is a cross-sectional view taken along lines VB—VB of FIG. 5.

A preferred embodiment of the channel-shaped 90° corner members 400 is illustrated in FIGS. 5, 5A and 5B. Each corner member 400 has two flat panels 402, 403. These two panels are attached to one another at an approximately 90° angle. Extending inward on each side of each panel 402, 403 are side panels 404–407 to form a channel into which the abutting corners of one of the vertical doorjambs 3 or 4 meets the top horizontal doorjamb 5 can snugly fit.

In a preferred embodiment each side panel 404–407 is provided with at least one opening 408 through which a nail, screw or other attaching means 409 can pass to secure side panel to the opposing doorjamb. Similarly, it is preferred that flat panels 402, 403 be provided with openings 410 to permit a nail, screw, or other attaching means 411 to fix the flat panel to the opposing wall stud. It is noted that if the sheet metal or other material structurally permits the driving of a nail or screw through it without the necessary of an opening, then such openings although preferred would not be necessary.

Figure 6:
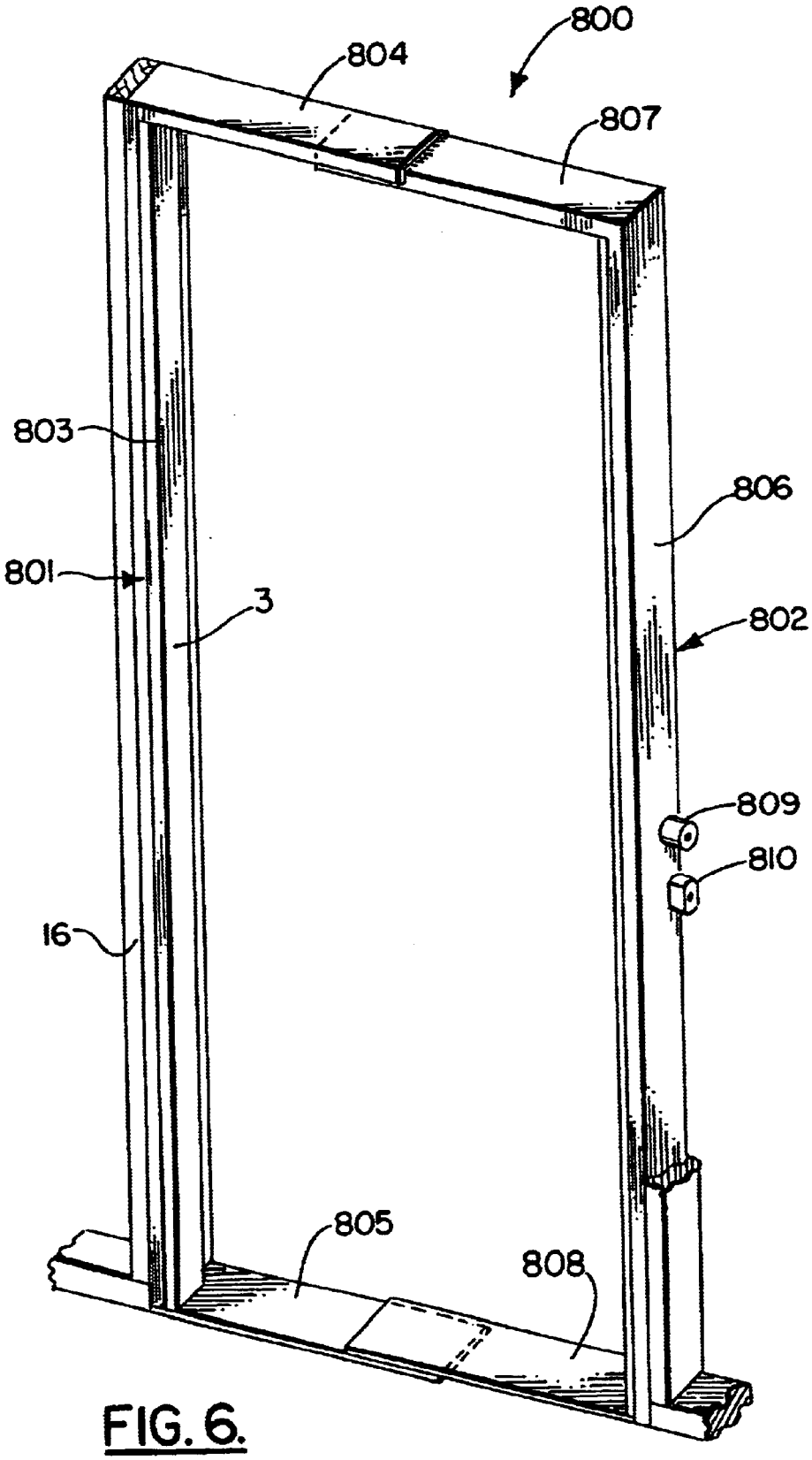
FIG. 6 is a perspective view of the most preferred embodiment of the reinforcing system of this invention.

FIG. 6 illustrates a most preferred alternate embodiment of this invention wherein the reinforcing system 800 comprises a door hinge side reinforcement member 801 and a latch side reinforcement member 802. The door hinge side reinforcement member 801 comprises a vertical channel-shaped section 803 that extends the height of stud 16 and is shaped to permit doorjamb 3 to fit into the channel formed by section 803 as illustrated. Door hinge side member 801 also comprises a top horizontal channel-shaped section 804 and a bottom horizontal flat plate section 805. The latch side reinforcement section 802 is similarly constructed having a vertical channel-shaped section 806, a top horizontal channel-shaped section 807 and a bottom flat plate section 808. Vertical channel shaped section 806 in shaped to permit doorjamb 4 to fit into the channel forward by section 806 as illustrated. Both top horizontal sections 804 and 807 are shaped to permit doorjamb member 5 to fit into both of the channels formed by sections 804 and 807. In a preferred embodiment the length of sections 804 and 807, as well as section 805 and 808 are set to ensure that they extend completely over the threshold overlap regardless if the doorway is 24" to 36" wide. Finally, vertical section 806 is provided with tubular members 809 and 810 to secure the door latch 13 and door lock 14, respectively.

In assembling the reinforcing system to the door frame one first mounts the striker 200, the channel-shaped members 300, and the 90° corner members 400 that are to be used to the wall studs. This is achieved by nailing, screwing or utilizing some other attaching means. Alternatively, the strike 200, the channel-shaped members 300, and the 90° corner members 400 can be positioned around the doorjamb members and then both nailed, screwed or otherwise attached to the wall studs. It is preferred that multiple nails or screws be used for each striker 200, channel-shaped member 300 and 90° corner member 400 to secure these members to the wall studs. Once assembled the reinforcing system of this invention provides significant improvement against the twisting forces imparted to a door frame when a person would attempt to kick in a door.

There are of course other alternate embodiments which are obvious from the foregoing descriptions of the invention which are intended to be included within the scope of the invention as defined by the following claims.

What I claim is:

1. A reinforcing system for strengthening a door frame positioned in a wall formed by structural members, the door frame having two parallel vertical doorjambs separated from one another by a top horizontal doorjamb, each doorjamb having an exterior side positionable adjacent a respective one of said structural members and having an interior side constructed having a stop rail against which a door engages when the door is in a closed position, each corresponding interior side and exterior side separated from one another by opposing sides, said reinforcing system comprising:

(a) two elongated channel-shaped 90° corner members, each of said corner members comprising one elongated flat panel bent in its longitudinal mid-section and having opposed edges along its length with two substantially parallel corresponding sides extending along and outward from said opposing edges each of said flat panels having a width and with said substantially parallel sides form a U-shaped channel to permit at least a portion of a respective one of said vertical doorjambs and at least a portion of said top horizontal doorjamb to be positioned in said U-shaped channel, said corner members sized to be positionable on opposite corners of said door frame, (b) at least one elongated channel-shaped member formed by an elongated flat panel with two substantially parallel sides extending along and outward from opposing longitudinal edges of said channel-shaped member flat panel, said channel-shaped member flat panel having a width to permit said substantially parallel sides of said channel-shaped member to be positioned adjacent said opposing sides of a respective one of said vertical doorjambs when said channel-shaped member flat panel is positioned adjacent said exterior side thereof, and (c) a strike having a plate containing at least one opening sized and positioned to receive a door fastener fixed to said door and comprising a first tubular body having a first end extending substantially perpendicular to one face of said plate and a second end opposite said first end, said tubular body being of a length sufficient to extend through an opening in a respective one of said vertical doorjambs and into a respective one of said structural members, said second end being closed by an end plate, said end plate provided with an opening shaped to permit an attaching device to extend into said respective one of said structural members to fix said tubular body thereto.

2. A reinforcing system according to claim 1 wherein there are third and fourth 90° corner members, each located at a lower end of a respective one of said vertical doorjambs.

3. A reinforcing system according to claim 2 further comprising:

(a) a first elongated flat member attachable to and extending between said two elongated channel-shaped 90° corner members, and, (b) a second elongated flat member attachable to and extending between one of of said two elongated channel-shaped 90° corner members and said strike.

4. A reinforcing system according to claim 3 further comprising a third elongated flat member attachable to and extending between the third and fourth 90° corner members.

5. A reinforcing system according to claim 4 further comprising a fourth elongated flat member attachable to and extending between said third 90° corner member and said strike, said fourth elongated flat member adapted to be positioned adjacent the stop rail on said door frame and adjacent a threshold of said door frame.

6. A reinforcing system according claim 5 wherein said corner members and channel-shaped member are constructed from 14 to 20 gauge sheet metal.

7. A reinforcing system according to claim 1 further comprising a elongated flat member attachable to and extending between one of said channel-shaped 90° corner members and said elongated channel-shaped metal member.

8. A reinforcing system according to claim 1 wherein said corner members and channel-shaped member are constructed from 14 and 20 gauge sheet metal.

9. A reinforcing system for strengthening a door frame formed by two vertically positioned, substantially parallel doorjambs separated at their upper end sections by a horizontally positioned doorjamb, each doorjamb adjacent a respective structural member forming a wall, each doorjamb constructed having an exterior side adjacent respective structural member and an interior side, having a stop rail against which a door engages when the door is in a closed position, said interior side and exterior side of each said doorjamb separated from one another by opposing sides, said reinforcing system comprising:

(a) a door hinge side reinforcement member comprising:

(i) a vertically positioned U-shaped channel door hinge side member, (ii) a horizonally positioned U-shaped channel door hinge side member extending substantially perpendicular from a top end of said vertically positioned U-shaped channel door hinge side member, and (iii) a horizonally positioned elongated door hinge side plate member extending substantially perpendicular from a bottom end of said vertically positioned U-shaped channel door hinge side member, wherein said vertically positioned U-shaped channel door hinge side member has a length and permits one of said vertical doorjambs to be positioned in its U-shaped channel, (b) a latch side reinforcement member comprising:

(i) a vertically positioned U-shaped channel latch side member having a top end and an opposing bottom end, (ii) a horizonally positioned U-shaped channel latch side member extending substantially perpendicular from said top end of said vertically positioned U-shaped channel latch side member, and (iii) a horizonally positioned elongated latch side plate member extending substantially perpendicular from said bottom end of said vertically positioned U-shaped channel latch side member, wherein said vertically positioned U-shaped channel latch side member has a length and permits the other one of said vertical doorjambs to be positioned in its U-shaped channel, wherein said horizontally positioned U-shaped channel door hinge side member and said horizontally positioned U-shaped channel latch side member have a combined length at least equal to a length of the horizontally positioned doorjamb, wherein said horizontally positioned door hinge side plate member and said horizontally positioned latch side plate member have a combined length at least equal to a length of a door threshold, and wherein said horizontally positioned U-shaped channel door hinge side member and said horizontally positioned U-shaped channel latch side member are sized and shaped to permit one to overlap the other.

10. A frame in combination with a reinforcing plate for strengthening a corner of said frame, said corner formed by an upper horizontal doorjamb and a vertical doorjamb, each of the doorjambs having an exterior side adjacent a respective structural member and an interior side having a stop rail against which a door engages when the door is in a closed position, said interior side and exterior side of each said doorjamb separated from one another by opposing sides, said reinforcing plate comprising an elongated channel shaped 90° corner metal member having a flat member bent at approximately 90° in-between its longitudinal ends and having two substantially parallel sides each extending along and outward from a respective opposite edge of said flat member, said flat member and said substantially parallel sides least a portion of said exterior and opposing sides of said upper horizontal doorjamb therein.

11. The combination according to claim 10 wherein said substantially parallel sides have a width at least approximately equal to a width of said opposing sides of the doorjambs.

* * * * *